United States Patent [19]

Bischofberger et al.

[11] Patent Number: 4,608,470

[45] Date of Patent: Aug. 26, 1986

[54] HIGH-VOLTAGE SWITCH

[75] Inventors: Walter Bischofberger, Niederweningen; Heinz Eichholzer, Thalwil; Werner Graber, Ennetbaden; Jiri Talir, Baden, all of Switzerland

[73] Assignee: BBC Brown Boveri & Company Ltd., Switzerland

[21] Appl. No.: 696,265

[22] Filed: Jan. 30, 1985

[30] Foreign Application Priority Data

Feb. 6, 1984 [CH] Switzerland ..... 548/84

[51] Int. Cl.[4] ..... H01H 33/16

[52] U.S. Cl. ..... 200/144 AP

[58] Field of Search ..... 200/144 AP

[56] References Cited

U.S. PATENT DOCUMENTS 4,500,762 2/1985 Yoshizumi ..... 200/144 AP

*Primary Examiner*—Robert S. Macon

*Attorney, Agent, or Firm*—Ostrolenk, Faber, Gerb & Soffen

[57] ABSTRACT

Between a fixed contact member (2) having a rated-current contact and a fixed arcing contact (3) which acts in conjunction with a moving contact member (4) having a moving rated-current contact (5) and moving arcing contact (6), and a first flange (7) an insertion resistance (8) is arranged.

In order to save a further pair of contacts, the rated-current contact of the fixed contact member (2) is constructed as a sliding rated-current contact (14) which can be displaced in the switching-on direction by the moving contact member (4). During the switching-on process, it is first contacted by the moving rated-current contact (5) which creates a current path including a resistance contact (9) and the insertion resistance (8). A little later, the insertion resistance (8) is bridged when the moving arcing contact (6) comes into contact with the fixed arcing contact (3), which is connected to the first flange (7) by means of a conductor (20). In the further course of the switching-on movement, the sliding rated-current contact (14) runs onto a rated-current bridging contact (19) and establishes a rated-current path.

During the switching-off process, a vacuum damping arrangement (17) causes the sliding rated-current contact (14) to trail the moving contact member (4) with delay so that the rated-current contacts separate before the arcing contacts.

19 Claims, 8 Drawing Figures

HIGH-VOLTAGE SWITCH

The invention relates to a high-voltage switch according to the pre-characterising clause of claim 1. Said switches are used for switching high voltage onto long transmission lines.

A high-voltage switch according to the pre-characterising clause of claim 1 is known (U.S. Pat. No. 4,338,500) in which, apart from a fixed and a moving rated-current contact and a fixed and a moving arcing contact, a third pair of contacts is provided which is used for switching the insertion resistance into circuit.

The invention has the object of constructionally simplifying and reducing the cost of switches of this type.

This object is achieved by the invention as characterised in the claims.

The advantages achieved by the invention can be seen particularly in the fact that only two pairs of contacts are required. This considerably simplifies the construction of generic switches. In addition, the invention makes it possible to construct such switches more easily and more compactly which also has a favourable effect on the dimensioning and costs of the housing and other parts.

Figure 1:
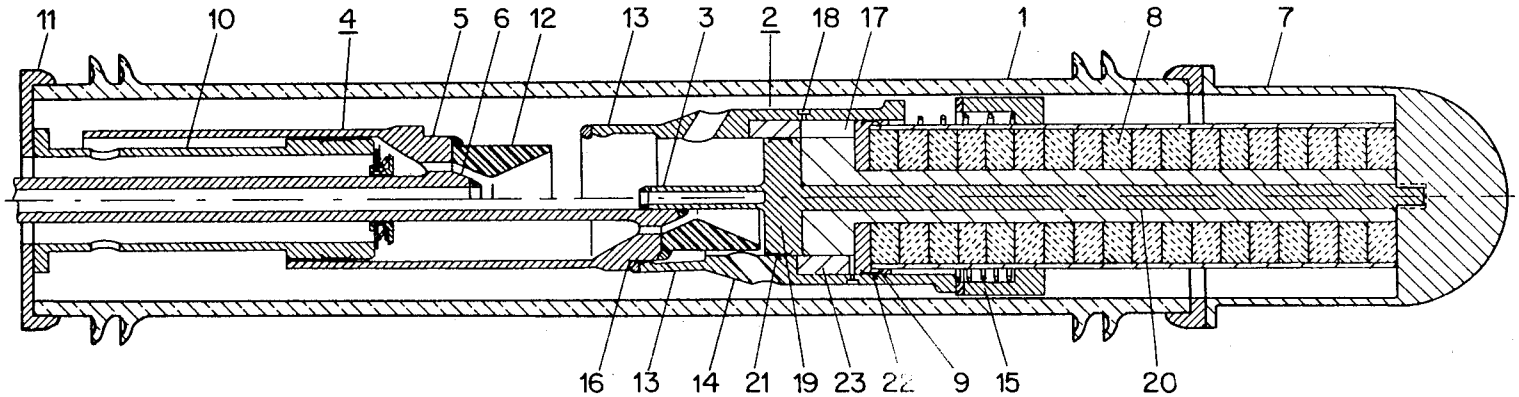
Figure 4:
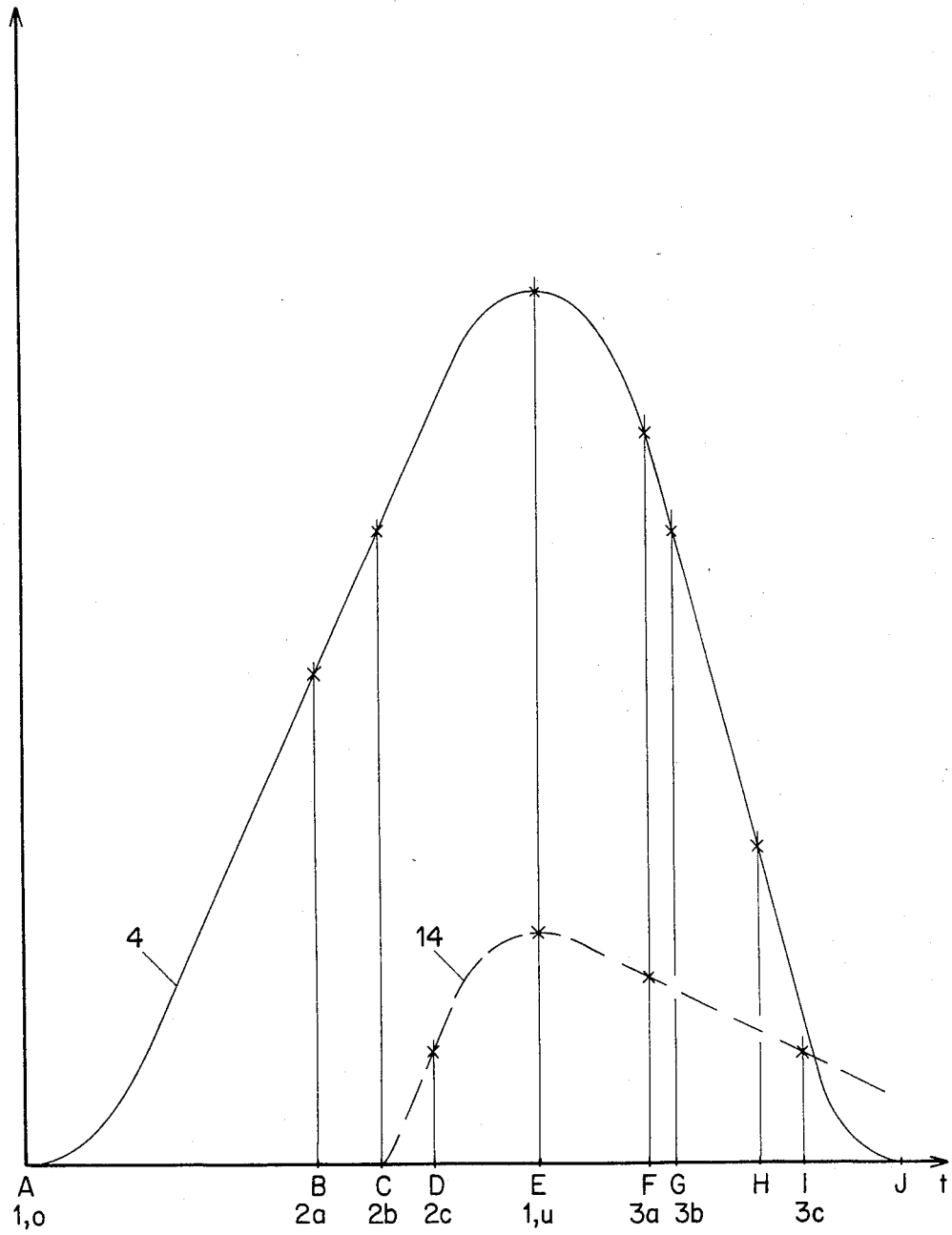

In the text which follows, the invention is explained in greater detail with the aid of drawings which represent only one embodiment and in which:

FIG. 1 shows an axial longitudinal section through a high-voltage switch according to the invention, at the top in its off-condition and at the bottom in its on-condition, FIGS. *2a–2c* show in each case one half of an axial longitudinal section through the contact members of the high-voltage switch according to the invention in intermediate conditions occurring in the course of the switching-on process, FIGS. *3a–3c* show corresponding longitudinal sections which correspond to intermediate conditions occurring in the course of the switching-off process, FIG. 4 shows diagrammatically the variation with time of the strokes of parts of the switch according to the invention during a switching-on process and a switching-off process.

In FIGS. 1, *2a–c*, *3a–c*, an essentially axially symmetric high-voltage switch is shown which in its fundamental configuration in a porcelain housing 1 contains a fixed contact member 2 having a rated-current contact and a fixed arcing contact 3 which is arranged in the area of the switch axis and is surrounded by the rated-current contact, and a moving contact member 4 having a moving rated-current contact 5 and a moving arcing contact 6.

Between the fixed contact member 2 and a flange 7, which forms a first electric connection, an insertion resistance 8 is arranged which is electrically placed between a resistance contact 9 and the flange 7 and which is bridged in the course of the switching-on process.

The moving contact member 4 is located above a fixed piston 10, in conjunction with which it forms a blowing device, which is electrically conductively connected to a second flange 11 which forms a second electric connection. At its end facing the fixed contact member 2 it carries a nozzle 12 of insulating material which coaxially surrounds the moving arcing contact 6.

At its end facing the moving contact member 2, the rated-current contact of the fixed contact member 2 is provided with a crown of contact fingers 13. In the on position, it is electrically conductively connected to the first flange 7.

According to the invention, the rated-current contact of the fixed contact member 2 is constructed as a sliding rated-current contact 14 which can be displaced in a limited way in the direction of switching on against the force of a spring 15 from a basic position assumed in the off position. The moving rated-current contact 5 is provided with a stop 16 which works in conjunction with the ends of the contact fingers 13 during the switching-on movement of the moving contact member 4.

A vacuum damping arrangement 17 comprising a valve 18 which opens when the sliding rated-current contact 14 is pushed back and is otherwise closed or only slightly permeable to gas ensures that, during the switching-off process, the sliding rated-current contact 14 is returned into the basic position with delay compared with the switching-off movement of the moving contact member 4.

A rated-current bridging contact 19, which is arranged inside the area surrounded by the sliding rated-current contact 14 and, in the on position, is in electric contact with the latter but is insulated from it when it is located in its basic position, is electrically conductively connected to the first flange 7 by means of a conductor 20 which is carried insulated through an axial hole in the insertion resistance 8.

The resistance contact 9 is continuously in electric contact with the sliding rated-current contact 14. The fixed arcing contact 3, like the rated-current bridging contact 19, is electrically conductively connected to the first flange 7 by means of the conductor 20. In the on position, it is insulated from the resistance contact 9 and can be electrically conductively connected to the latter at the most via the rated-current bridging contact 19 and the sliding rated-current contact 14.

The sliding rated-current contact 14 and the rated-current bridging contact 19 are arranged relative to each other in such a manner that the electric contact, which occurs between them as a result of the displacement of the sliding rated-current contact 14 in the switching-on direction occurring during the switching-on movement is established only after the fixed arcing contact 3 is contacted by the moving arcing contact 6. This prevents premature arcing between the sliding rated-current contact 14 and the rated-current bridging contact 19.

The contact areas of the rated-current bridging contact 19 and of the resistance contact 9 are constructed in the shape of a cylinder jacket and work in conjunction with contact zones 21, 22, which also have the shape of cylinder jackets, on the inside surface of the sliding rated-current contact 14. In this arrangement, the resistance contact 9 is arranged on the on-side of the rated-current bridging contact 19 and its contact area has a greater radius than that of the rated-current bridging contact 9. Adjoining the on side of the contact zone 21 working in conjunction with the rated-current bridging contact 19 a ring 23 of insulating material is attached to the sliding rated-current contact 14 the inner surface of which surrounds the rated-current bridging contact 19 and insulates it from the sliding rated-current contact 14 when the sliding rated-current contact 14 is in its basic position or is only slightly displaced with respect to this position.

In the text which follows, the operation of the switch shown is explained with the aid of FIGS. 1, *2a–c*, *3a–c*, 4.

In FIG. 4, time is plotted along the abscissa and the stroke of the moving contact member 2 (continuous line) and the displacement of the sliding rated-current contact 14 from the basic position (dashed line) are plotted along the ordinate. The designations 1,*o*, 1,*u*, 2*a*, 2*b*, 2*c*, 3*a*, 3*b*, 3*c* below the abscissa refer to the upper and lower half of FIG. 1 and to FIGS. 2*a–c*, 3*a–c* representing the condition of the switch reached in each case at the given time.

Figure 2A:
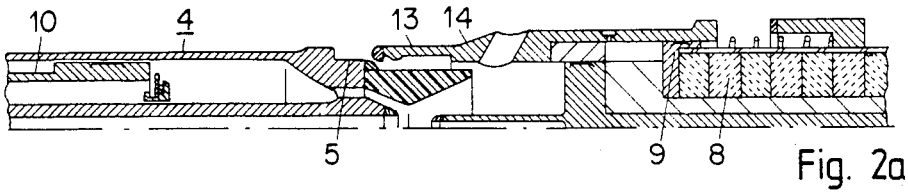

From the off condition, assumed at time A and shown in the upper half of FIG. 1, in which the sliding rated-current contact 14 is in its basic position and is insulated from the rated-current bridging contact 19, the contact area 21 of which is surrounded by the inside surface of the ring 23 of insulating material, the moving contact member 2 is brought into a first intermediate condition which is reached at time B, shown in FIG. 2*a*, in which the moving rated-current contact 5 and contact fingers 13 of the sliding rated-current contact 14 just come into contact with each other, premature arcing occurring before the contacts touch each other being captured by the ends, which are constructed to be resistant to burning, of the said contacts. From this time, a continuous current path exists from the first flange 7 via the insertion resistance 8, the resistance contact 9, the sliding rated-current contact 14, the moving contact member 4 and the piston 10 to the second flange 11.

Figure 2B:
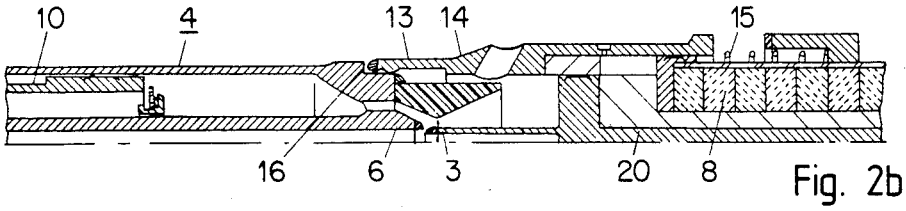

About 8 ms later, at time C, the switch reaches a second intermediate condition, shown in FIG. 2*b*, in which the moving arcing contact 6 just reaches the fixed arcing contact 3, the premature arcing, which again occurs because of the voltage drop across the insertion resistance 8, being captured by the ends, which in any case are constructed to be resistant to burning, of the arcing contacts. The contact between the fixed arcing contact 3 and the moving arcing contact 6 establishes a further electrically conductive connection between the first flange 7 and the second flange 11. It includes the conductor 20, the fixed arcing contact 3, the moving contact member 4 and the piston 10. This bridges the insertion resistance 8. At approximately the same time C, the stop 16 meets the tips of the contact fingers 13 of the sliding rated-current contact 14 which is still in its basic position. During the further course of the switching-on movement of the moving contact member 4, the sliding rated-current contact 14 is carried along by the former and pushed against the force of the spring 15 in the switching-on direction.

Figure 2C:
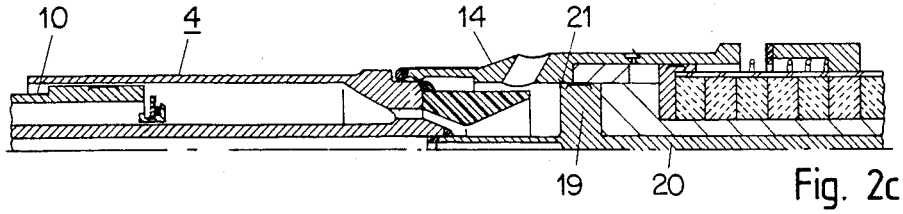

At a time D, the switch reaches an intermediate condition shown in FIG. 2*c*, in which the contact zone 21 of the sliding rated-current contact 14 just reaches the contact segment of the rated-current bridging contact 19 which establishes a rated-current path which connects the conductor 20 via the rated-current bridging contact 19 and the sliding rated-current contact 14 to the moving contact member 4. The further course of the switching-on movement brings the switch into the on position shown in the lower half of FIG. 1 at a time E.

Figure 3A:
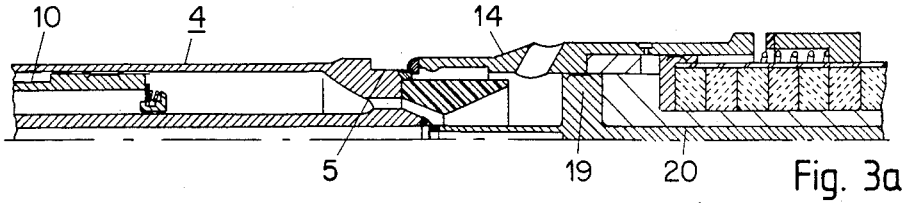

In the course of the switching-off process, the switch reaches a fourth intermediate condition, shown in FIG. 3*a* at time F, in which condition the moving rated-current contact 5 just separates from the sliding rated-current contact 14 which trails it with delay. From this time, the rated-current path is interrupted.

Figure 3B:
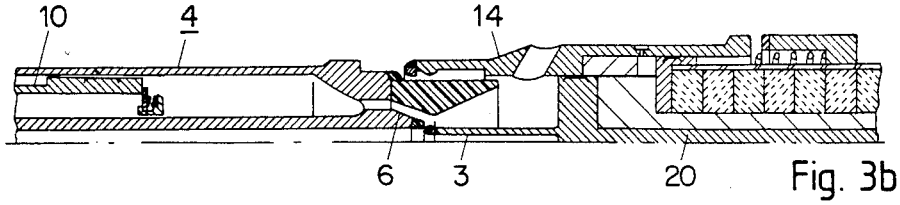

At a somewhat later time G, a fifth intermediate condition is reached, shown in FIG. 3*b*, in which the moving arcing contact 6 just separates from the fixed arcing contact 3. Between these contacts an arc is drawn which is blown and the quenching of which is completed at a time H.

Figure 3C:
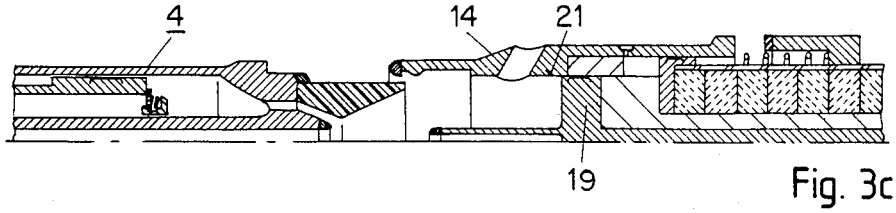

At a somewhat later time I, a sixth intermediate condition shown in FIG. 3*c* is reached in which the moving contact member 4 has almost returned to the position assumed in the off position and the contact zone 21 at the sliding rated-current contact 14 runs off the contact segment of the rated-current bridging contact 19 while the sliding rated-current contact is being returned to its basic position.

At time J, the moving contact member 4 reaches the position assumed in the off position and a little later also the sliding rated-current contact 14 which is trailing with delay.

We claim:

1. High-voltage switch comprising a first electric connection and a second electric connection, a fixed contact member (2) which contains two contact pieces, these being a rated-current contact which is electrically conductively connected to the first electric connection at least in the on position, and a fixed arcing contact (3), a moving contact member (4) which is electrically conductively connected to the second electric connection and which contains two opposite contact pieces, these being a moving rated-current contact (5) and a moving arcing contact (6).

an insertion resistance (8) which is placed between the first electric connection and a resistance contact (9) and which is bridged in the course of the switching-on process, characterised in that the rated-current contact of the fixed contact member (2) is constructed as a sliding rated-current contact (14) which can be displaced, with respect to the fixed arcing contact (3), by the moving contact member (4) in the course of the switching-on movement of the latter against the force of elastic means in a limited way in the switching-on direction from a basic position which is assumed at least in the off position, and is electrically conductively connected to the fixed arcing contact (3) at least in the on position, and is in electric contact, at least in the on position but not in the basic position, with a rated-current bridging contact (19) which is electrically conductively connected to the first electric connection, the resistance contact (9) is electrically conductively connected, during the switching-on process at least until the bridging, which occurs in the course of the latter, of the insertion resistance (8), at least to that contact piece of the fixed contact member (2) which is the first to be contacted by the corresponding opposite contact piece in the course of the switching-on movement of the moving contact member (4).

2. High-voltage switch according to claim 1, characterised in that the fixed contact member (2) and the moving contact member (4) are constructed in such a manner that, in the course of the switching-on movement of the moving contact member (4), the sliding rated-current contact (14) is contacted by the corresponding opposite contact piece before the fixed arcing contact (3), the fixed arcing contact (3) is electrically conductively connected to the first electric connection, and the resistance contact (9) is insulated from the fixed arcing contact (3), during the switching-on process, at least until the bridging of the insertion resistance occurring in the course of the latter.

3. High-voltage switch according to claim 1, characterised in that a stop (16) is provided which is effective between the sliding rated-current contact (14) and the moving contact member (4) and which is reached in the course of the switching-on movement of the moving contact member (4) and in the further course of this movement effects the displacement of the sliding rated-current contact (14) of the fixed contact member (2) in the switching-on direction.

4. High-voltage switch according to claim 2, characterised in that a stop (16) is provided which is effective between the sliding rated-current contact (14) and the moving contact member (4) and which is reached in the course of the switching-on movement of the moving contact member (4) and in the further course of this movement effects the displacement of the sliding rated-current contact (14) of the fixed contact member (2) in the switching-on direction.

5. High-voltage switch according to claim 2, characterised in that damping means are provided which, during the switching-off process, delay the returning of the sliding rated-current contact (14) into its basic position with respect to the switching-off movement of the moving contact member (4).

6. High-voltage switch according to claim 3, characterised in that damping means are provided which, during the switching-off process, delay the returning of the sliding rated-current contact (14) into its basic position with respect to the switching-off movement of the moving contact member (4).

7. High-voltage switch according to claim 4, characterised in that damping means are provided which, during the switching-off process, delay the returning of the sliding rated-current contact (14) into its basic position with respect to the switching-off movement of the moving contact member (4).

8. High-voltage switch according to claim 2, characterised in that the sliding rated-current contact (14) and the rated-current bridging contact (19) are arranged relatively to each other in such manner that the electric contact, occurring in the course of the displacement, effected by the switching-on movement of the moving contact member (4), of the former in the switching-on direction, is established between them only after the fixed arcing contact (3) is contacted by the moving arcing contact (6) which contacting occurs in the course of the switching-on movement of the moving contact member (4).

9. High-voltage switch according to claim 3, characterised in that the sliding rated-current contact (14) and the rated-current bridging contact (19) are arranged relatively to each other in such manner that the electric contact, occurring in the course of the displacement, effected by the switching-on movement of the moving contact member (4), of the former in the switching-on direction, is established between them only after the fixed arcing contact (3) is contacted by the moving arcing contact (6) which contacting occurs in the course of the switching-on movement of the moving contact member (4).

10. High-voltage switch according to claim 4, characterised in that the sliding rated-current contact (14) and the rated-current bridging contact (19) are arranged relatively to each other in such manner that the electric contact, occurring in the course of the displacement, effected by the switching-on movement of the moving contact member (4), of the former in the switching-on direction, is established between them only after the fixed arcing contact (3) is contacted by the moving arcing contact (6) which contacting occurs in the course of the switching-on movement of the moving contact member (4).

11. High-voltage switch according to claim 2, this switch being constructed to be at least approximately axially symmetric, the fixed arcing contact (3) being arranged in the area of the axis and being coaxially surrounded at a distance by the sliding rated-current contact (14), and the insertion resistance (8) being arranged between the fixed contact member (2) and a first flange (7) forming the first electric connection, characterised in that the rated-current bridging contact (19) is arranged within the area surrounded by the sliding rated-current contact (14) and the electrically conductive connection between the rated-current bridging contact (19) and the first flange (7) and also that between the fixed arcing contact (3) and the first flange (7) are established by means of a conductor (20) which is carried insulated through an axial hole in the insertion resistance (8).

12. High-voltage switch according to claim 3, this switch being constructed to be at least approximately axially symmetric, the fixed arcing contact (3) being arranged in the area of the axis and being coaxially surrounded at a distance by the sliding rated-current contact (14), and the insertion resistance (8) being arranged between the fixed contact member (2) and a first flange (7) forming the first electric connection, characterised in that the rated-current bridging contact (19) is arranged within the area surrounded by the sliding rated-current contact (14) and the electriclaly conductive connection between the rated-current bridging contact (19) and the first flange (7) and also that between the fixed arcing contact (3) and the first flange (7) are established by means of a conductor (20) which is carried insulated through an axial hole in the insertion resistance (8).

13. High-voltage switch according to claim 4, this switch being constructed to be at least approximately axially symmetric, the fixed arcing contact (3) being arranged in the area of the axis and being coaxially surrounded at a distance by the sliding rated-current contact (14), and the insertion resistance (8) being arranged between the fixed contact member (2) and a first flange (7) forming the first electric connection, characterised in that the rated-current bridging contact (19) is arranged within the area surrounded by the sliding rated-current contact (14) and the electrically conductive connection between the rated-current bridging contact (19) and the first flange (7) and also that between the fixed arcing contact (3) and the first flange (7) are established by means of a conductor (20) which is carried insulated through an axial hole in the insertion resistance (8).

14. High-voltage switch according to claim 11, characterised in that the contact areas of the rated-current bridging contact (19) and of the resistance contact (9)

are essentially constructed to have the shape of cylinder jackets and work in conjunction with contact zones (21, 22), which also have the shape of cylinder jackets, at the inner surface of the liding rated-current contact (14).

15. High-voltage switch according to claim 12, characterised in that the contact areas of the rated-current bridging contact (19) and of the resistance contact (9) are essentially constructed to have the shape of cylinder jackets and work in conjunction with contact zones (21, 22), which also have the shape of cylinder jackets, at the inner surface of the sliding rated-current contact (14).

16. High-voltage switch according to claim 13, characterised in that the contact areas of the rated-current bridging contact (19) and of the resistance contact (9) are essentially constructed to have the shape of cylinder jackets and work in conjunction with contact zones (21, 22), which also have the shape of cylinder jackets, at the inner surface of the sliding rated-current contact (14).

17. High-voltage switch according to claim 14, characterised in that the resistance contact (9) is arranged on the side of the rated-current bridging contact (19) and the radius of its contact area is greater than that of the contact area of the rated-current bridging contact (19) and that a ring (23) of insulating material is attached to the sliding rated-current contact (14) on the on side of the contact zone (21) acting in conjunction with the contact area of the rated-current bridging contact (19), the inside radius of this ring corresponding at least approximately to the radius of the said contact zone (21) and the inner surface of which surrounds the contact area of the rated-current bridging contact (19) at least when the sliding rated-current contact (14) is located in its basic position.

18. High-voltage switch according to claim 15, characterised in that the resistance contact (9) is arranged on the side of the rated-current bridging contact (19) and the radius of its contact area is greater than that of the contact area of the rated-current bridging contact (19) and that a ring (23) of insulating material is attached to the sliding rated-current contact (14) on the side of the contact zone (21) acting in conjunction with the contact area of the rated-current bridging contact (19), the inside radius of this ring corresponding at least approximately to the radius of the said contact zone (21) and the inner surface of which surrounds the contact area of the rated-current bridging contact (19) at least when the sliding rated-current contact (14) is located in its basic position.

19. High-voltage switch according to claim 16, characterised in that the resistance contact (9) is arranged on the side of the rated-current bridging contact (19) and the radius of its contact area is greater than that of the contact area of the rated-current bridging contact (19) and that a ring (23) of insulating material is attached to the sliding rated-current contact (14) on the side of the contact zone (21) acting in conjunction with the contact area of the rated-current bridging contact (19), the inside radius of this ring corresponding at least approximately to the radius of the said contact zone (21) and the inner surface of which surrounds the contact area of the rated-current bridging contact (19) at least when the sliding rated-current contact (14) is located in its basic position.

* * * * *